United States Patent [19]

Wilson

[11] Patent Number: 4,852,274

[45] Date of Patent: Aug. 1, 1989

[54] THERAPEUTIC SHOE

[76] Inventor: James T. Wilson, 132 Barrington Dr., Brandon, Fla. 33511

[21] Appl. No.: 121,687

[22] Filed: Nov. 16, 1987

[51] Int. Cl.[4] ..... A43B 13/20; A43B 13/18

[52] U.S. Cl. ..... 36/29; 36/28

[58] Field of Search ..... 36/28, 29, 88, 43, 25 R, 36/71, 7.8, 11.5, 35 R, 35 B

[56] References Cited

U.S. PATENT DOCUMENTS

| | | | |
|---|---|---|---|
| 1,516,395 | 11/1924 | Miceli | 36/7.8 |
| 2,968,105 | 1/1961 | Rizzo | 36/29 |
| 4,227,320 | 10/1980 | Borgeas | 36/29 |
| 4,358,902 | 11/1982 | Cole et al. | 36/35 B |
| 4,446,634 | 5/1984 | Johnson et al. | 36/29 |
| 4,458,430 | 7/1984 | Peterson | 36/35 B |
| 4,577,417 | 3/1986 | Cole | 36/29 |
| 4,768,295 | 9/1988 | Ito | 36/29 |

*Primary Examiner*—Steven N. Meyers

*Attorney, Agent, or Firm*—Dominik, Stein, Saccocio, Reese, Colitz & Van Der Wall

[57] ABSTRACT

A shoe including an upper component and a sole component for receiving the foot of a wearer therebetween. The shoe also includes a plurality of force absorbing units positioned between the upper and sole components. Each unit has a first portion to receive the wearer's foot thereon and a remote second portion whereby, in response to forces exerted on the units by the wearer's foot, the first portions of the units will contract and the second portions of the units will expand to thereby absorb and distribute such exerted forces.

16 Claims, 2 Drawing Sheets

THERAPEUTIC SHOE

BACKGROUND OF THE INVENTION

1. Field of the Invention

This invention relates to a therapeutic shoe and, more particularly, to therapeutic jogging shoes with a plurality of individual toroid shaped members positionable beneath the foot of a wearer for absorbing and distributing the forces generated by the wearer during use.

2. Description of the Background Art

During running, particularly during jogging and long distance running, the runner's heels strike the ground generating an impact or shock force which is then followed by a sequential shifting of the force from the heel, through the arch area, and then to the toe portion of the foot. The repeated striking of the heel and other portions of the runner's foot on the ground will generate physically detrimental forces on the foot which are transmitted throughout the runner's body in a determinable manner and of a predictable magnitude.

To minimize this problem, shoe manufacturers are continually improving the design and construction of shoes, particularly running shoes, in a effort to absorb as much as possible of the detrimental forces. These efforts for improvement frequently involve the engineering of the resiliency of the material of which the shoe is made. In the alternative, inserts of one design or another may be placed inside the shoes beneath the wearer's feet.

While progress has been made in improving the performance of running shoes, most users still experience difficulty, including the development of soreness and injury, particularly to the feet but even occasionally throughout the entire body from the effects of running with shoes of known types.

Various approaches are disclosed in the literature to minimize the forces between ground and runner as through the use of force absorbing shoes or shoe components. In U.S. Pat. No. 4,445,284 to Sakutori, for example, individual parallel pneumatic tubes are located across the majority of the extent of the shoe sole. Parallel tubes of varying diameters, coupled one to another, are disclosed in U.S. Pat. No. 4,593,482. Interconnected chambers in the soles of shoes are disclosed in U.S. Pat. No. 4,217,705 to Donzis and in 4,229,889 to Petrosky as well as in 4,446,634 to Johnson. Resilient, non-pneumatic chambers in soles of shoes are disclosed in U.S. Pat. Nos. 4,170,078 to Moss and 4,611,412 to Cohen. A coiled air tube, limited to the heel region of a shoe, is disclosed in U.S. Pat. No. 545,705 to MacDonald. Other types of force reducing soles include rheopexic sections, inverted collapsible pyramids and varying types of compressive sections. Note U.S. Pat Nos. 4,471,538 to Pomeranz, 4,521,979 to Blaser and 4,297,797 to Meyers.

Although many such advances are noteworthy to one extent or another, none achieves the objective of a lightweight, effective, inexpensive therapeutic running shoes designed to accommodate the specific needs of the specific runner, taking into account the particular force distribution generated by and on the different parts of the runner's foot during running.

An optimum assembly would be something new which combines the benefits of the prior approaches without their shortcomings, i.e., a shoe which provides for maximum force absorption, redistributes the detrimental forces evenly over the wearer's foot and body, accommodates the wearer's particular weight and running style, and which is economical to manufacture.

As illustrated by the great number of prior patents as well as commercial devices, efforts are continuously being made in an attempt to improve therapeutic running shoes to render them more efficient, effective, comfortable and economical. None of these previous efforts, however, provides the benefits attendant with the present invention. Additionally, prior shoes do not suggest the present. inventive combination of component elements arranged and configured on disclosed and claimed herein. The present invention achieves its intended purposes, objects and advantages over the prior art devices through a new, useful and unobvious combination of component elements, with the use of a minimum number of functioning parts, at a reasonable cost to manufacture, and by employing only readily available materials.

Therefore, it is an object of this invention to provide an improved therapeutic shoe which includes an upper component and a sole component for receiving the foot of a wearer therebetween and a plurality of force absorbing units positioned between the upper and sole components with each unit having a first portion to receive the wearer's foot thereon and a remote second portion whereby, in response to forces exerted on the units by the wearer's foot, the first portions of the units will contract and the second portions of the units will expand to thereby absorb and distribute such exerted forces.

It is another object of this invention to absorb and redistribute the forces generated by a runner.

It is a further object of the invention to tailor therapeutic shoes which abate detrimental forces on the wearer as a function of the weight and running style of the wearer.

Lastly, it is an object of the present invention to provide an improved jogging shoe with resilient, toroid shaped shells filled with high viscosity fluid which shifts to contract the shell at the area adjacent to the wearer's foot in response to the forces generated by the wearer.

The foregoing has outlined some of the more pertinent objects of the invention. These objects should be construed to be merely illustrative of some of the more prominent features and applications of the intended invention. Many other beneficial results can be attained by applying the disclosed invention in a different manner or by modifying the invention within the scope of the disclosure. Accordingly, other objects and a fuller understanding of the invention may be had by referring to the summary of the invention and the detailed description of the preferred embodiment in addition to the scope of the invention defined by the claims taken in conjunction with the accompanying drawings.

SUMMARY OF THE INVENTION

The invention is defined by the appended claims with the specific embodiment shown in the attached drawings. For the purpose of summarizing the invention, the invention may be incorporated into an improved shoe which includes an upper component and a sole component for receiving the foot of a wearer therebetween. The shoe also includes a plurality of force absorbing units positioned between the upper and sole components. Each unit has a first portion to receive the wearer's foot thereon and a remote second portion whereby, in response to forces exerted on the units by the wearer's foot, the first portions of the units will contract and the second portions of the units will expand to thereby absorb and distribute such exerted forces. The shoe further includes and intermediate component located between the upper and sole components with the first portions of the units located above the intermediate component. The units are shaped as toroids with their upper portions above the intermediate component and with their second portions beneath the intermediate component. The toroid shaped units are formed of shells of resilient material filled with fluid. The fluid is a high viscosity silicone. The fluid in each shell is at a pressure such that its shell will not deform substantially when subjected to conditions of static forces but will deform substantially when subjected to conditions of greater than static forces. The deformation of each shell occurs as fluid shifts within its shell from the portion above the intermediate component to the portion below the intermediate component to expand the shell below the intermediate component. The shell resiles upon the relief of the deforming force to return fluid to the portion above the intermediate component. Each shell is constructed and pressurized with fluid to deform in response to a particular, individual magnitude of force determined as a function of the weight of the wearer and the magnitude of force anticipated to be generated on each unit as a result of use by its wearer. The units are constructed and positioned to deform in response to magnitudes of lesser forces adjacent to the central part of the intermediate component and to magnitudes of greater forces adjacent to front and back parts of the intermediate component.

In addition, for the purposes of summarizing the invention, the invention may also be incorporated into a therapeutic shoe for use by a wearer which comprises, in combination, an upper positionable over the foot of a wearer, a sole peripherally secured to the upper and located beneath the foot of a wearer, an intermediate platform located between the upper and the sole to define a lower area therebeneath and an upper area thereabove for the receipt of a foot of wearer and a plurality of toroid shaped, force absorbing means located in parallel relationship with each other along the length of the platform from adjacent to the heel end of the shoe to adjacent to the toe end of the shoe. The means have their upper extents located in the upper area on the upper surface of the platform for being contacted and contracted by the foot of a wearer. The means have their lower extents located in the lower area proximate to the lower surface of the platform for being expanded in response to the means being contracted in the upper area. The platform is formed with pairs of laterally spaced notches along its length for the receipt of a means through each pair of openings. The therapeutic shoe further includes a support member located in the lower area in contact with the lower face of the platform and the upper face of the sole and extending along the length of the shoe. The support member defines channels of a size and location corresponding to the lower extents of the force absorbing means. The support members are formed as upward extensions of the sole. The support members are formed as downward extensions of the intermediate member.

Lastly, for the purpose of summarizing the invention, the invention may be incorporated into a therapeutic shoe for use as by a wearer during jogging or the like. The shoe comprises, in combination, an upper positionable over the foot of a wearer, a sole peripherally secured with respect to the upper beneath the foot of a wearer, an intermediate platform located between the upper and the sole to define a lower chamber therebeneath and an upper chamber thereabove for the receipt of a foot of a wearer, and a plurality of force absorbing elements located in parallel relationship with each other along the length of the platform from adjacent to the heel part of the shoe to adjacent to the toe part of the shoe. The units are shaped as toroids with walls of resilient material filled with high viscosity fluid under pressure. The elements have their upper extents located in the upper chamber on the upper surface of the platform for being contacted and contracted by the foot of a wearer and their lower extents located in the lower chamber on the lower surface of the platform for being expanded in response to the elements being contracted in the upper chamber. The fluid in each of the walls is at a pressure such that their walls will not deform substantially when subjected to normal conditions of static forces but will deform substantially when subjected to conditions of dynamic forces with the deformation of the walls occurring as fluid shifts to the lower chamber below the platform to expand the walls. The walls resile upon the relief of the deforming force to return fluid to the upper chamber above the platform. Each of the walls is adapted to deform in response to a particular, individual force determined as a function of the weight of the wearer and the force anticipated to be generated on that element as a result of jogging or the like by its wearer. The elements are constructed and positioned to deform in response to lesser forces adjacent to the central part of the shoe and in response to greater forces adjacent to toe and heel parts of the shoe.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be had to the following detailed description taken in conjunction with the accompanying drawings in which.

DETAILED DESCRIPTION OF THE INVENTION

Figure 1:
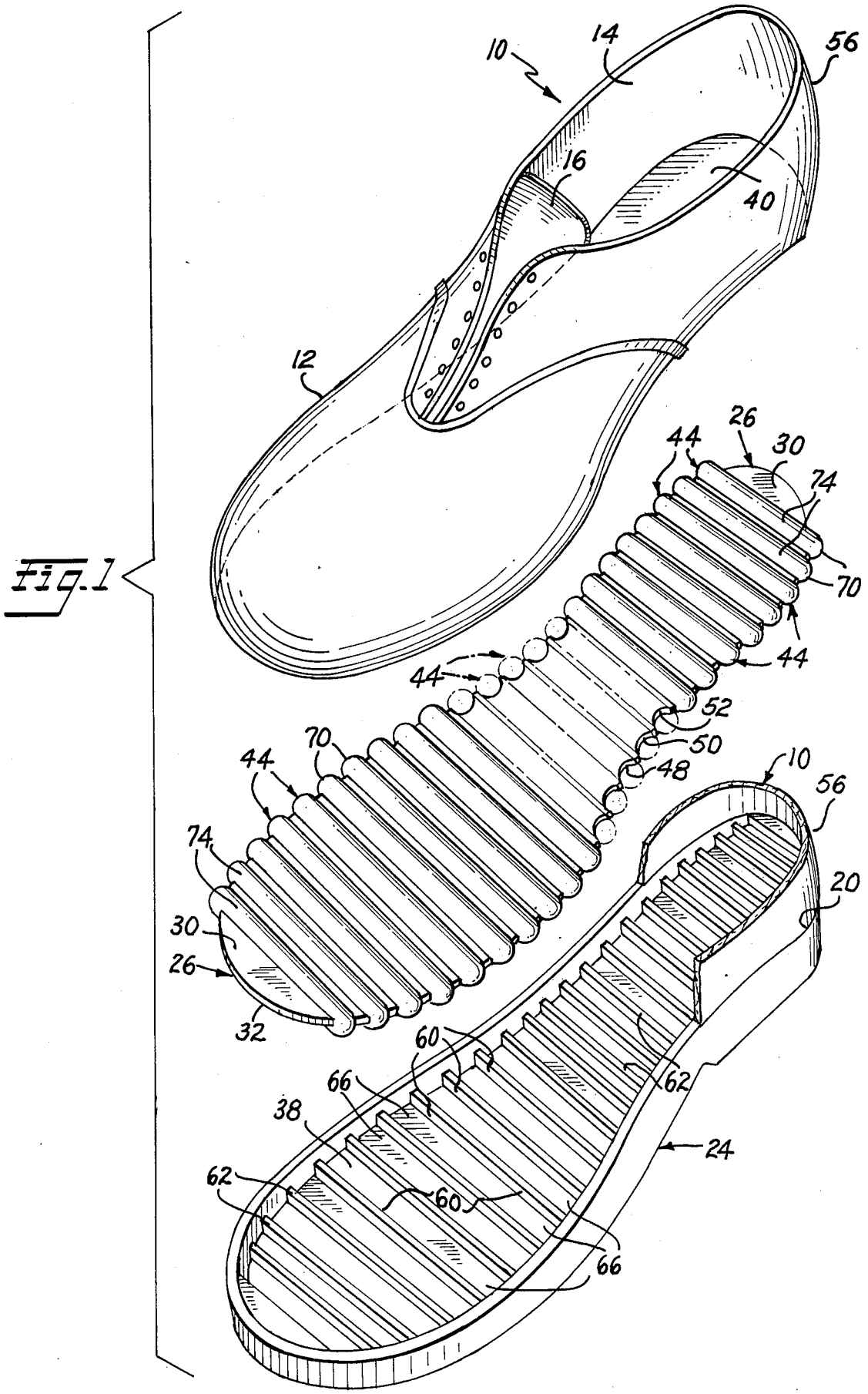
FIG. 1 is an exploded perspective illustration of a therapeutic jogging shoe constructed in accordance with the principles of the present invention.
Figure 2:
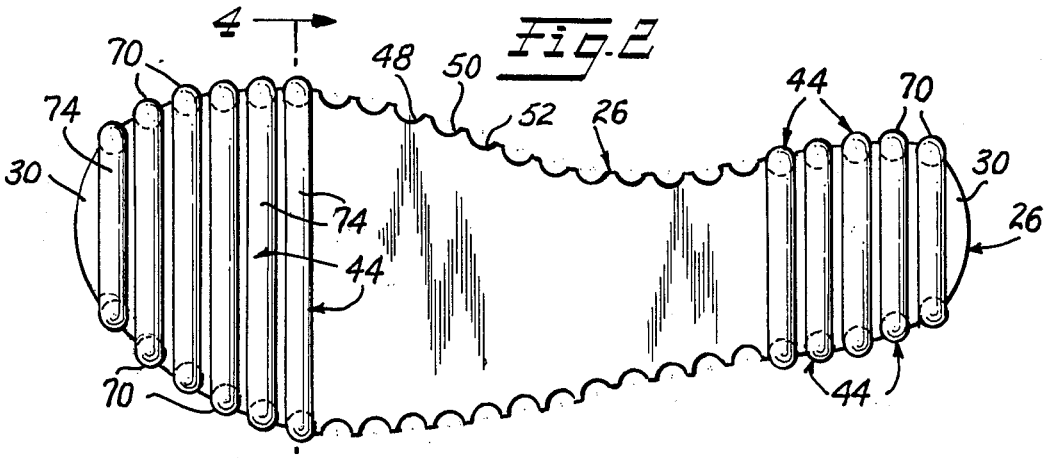
FIG. 2 is a plan view of the force absorbing units mounted on the intermediate member as shown in FIG. 1.
Figure 3:
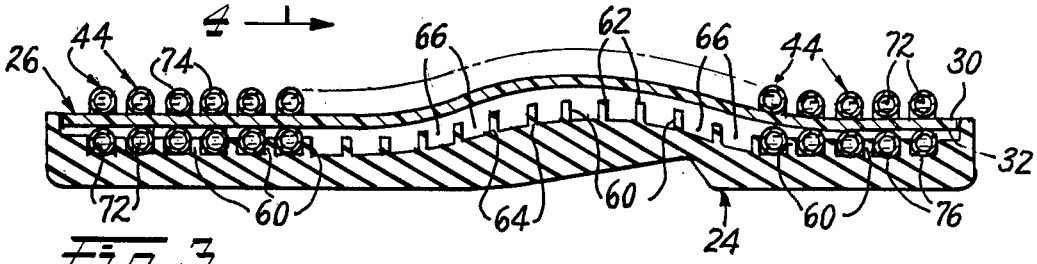
FIG. 3 is a longitudinal vertical sectional view of the shoe shown in FIGS. 1 and 2.

With reference to FIG. 1, there is shown a therapeutic shoe 10 constructed in accordance with the principles of the present invention. It is primarily designed for jogging or other long distance running. It should be appreciated, however, that it could readily be used, or adapted for use, during walking or sprinting.

Like a conventional shoe, the shoe of the present invention includes, at its upper extent, an upper component or upper 12 positionable over the instep of a foot of a wearer. The upper 12 may be fabricated of any material or fabric, natural or synthetic, for providing support to the foot of the wearer. And again as with a conventional shoe, it is provided with an opening 14 for receiving the wearer's foot. It is also preferably provided with a tongue 16 and laces for securing the shoe to the received foot.

Secured to the upper at the periphery 20, as by stitching or by an adhesive, is a sole component or sole 24, again essentially conventional in its design. The sole is shaped to generally conform with the bottom of the wearer's foot. It is sufficiently flexible to bend with the bending of the wearer's foot when in use, but sufficiently hard to protect the wearer's foot.

Located between the upper 12 and the sole 24 is an intermediate platform 26. The platform 26 is a relatively thin member, sufficiently rigid so as to normally retain its generally flat shape but sufficiently flexible so as to bend and flex like the sole with the movement of the foot during walking or running. The periphery of the platform 26 is secured to the periphery of the upper 12 and the sole 24. The upper and lower surfaces 30 and 32 of the platform are spaced from the lower and upper surfaces 36 and 38 of the upper and sole, respectively. In this manner, an upper chamber 40 and a lower chamber 42 are formed on opposite sides of the platform. The upper chamber 40 is of a sufficient size to receive the foot of a wearer. The lower chamber 42 is preferably significantly smaller, merely of such size as to receive force absorbing units or elements 44.

Formed in the intermediate platform 26 are a plurality of pairs of notches 48, 50, 52, etc. extending along each side of each platform from adjacent the back or heel portion 56 of the shoe and platform to the front or toe portion 58 of the heel or platform. The notches are circular in cross-section and of a size to receive and position the force absorbing elements 44.

Within the lower chamber are a series of support members 60 for supporting and retaining the intermediate platform, sole and force absorbing elements in position with respect to each other during non-use, standing, walking or running. The support members each have an upper edge 62 which may be spaced from or in contact with the lower surface of the intermediate platform between the heel portion and the toe portion. The lower edge 64 of the support members are formed as an upwardly extending portion of the upper surface of the sole between the heel portion and the toe portion. A plurality of transverse channels 66 are thus formed in the lower chamber. Such chambers 66 are equal in number and position to the force absorbing elements and the pairs of holes formed in the intermediate platform. The support members are sufficiently rigid so as to normally retain its generally rectangular shapes but sufficiently flexible so as to slightly bend and flex with the sole and intermediate platform with the movement of the foot during walking or running. The preferred material is a moderately stiff polyethylene or polyurethane, formed as thin as possible, and which is only slightly flexible.

Figure 5:
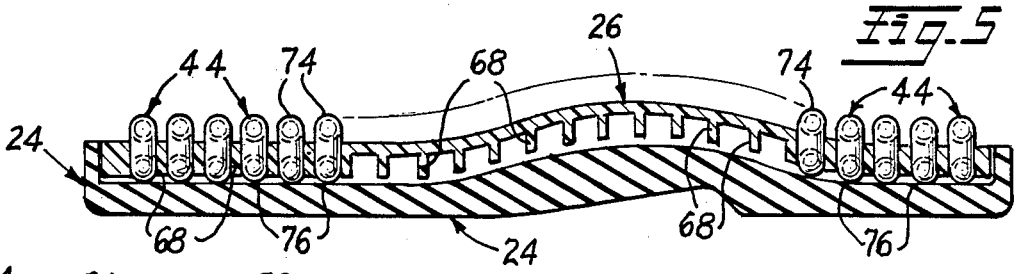
FIG. 5 is a longitudinal vertical sectional view of the shoe similar to FIG. 3 but showing an alternate embodiment of the invention.
Figure 4:
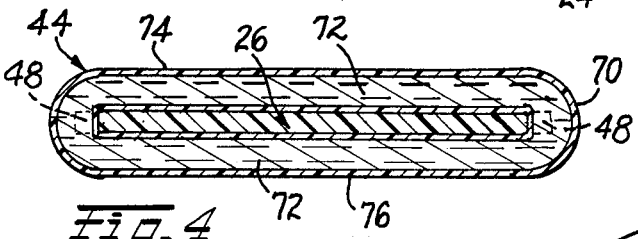
FIG. 4 is an enlarged transverse vertical sectional view of the shoe shown in FIGS. 1 and 2 taken along line 4—4 of FIG. 2.

In an alternate embodiment as shown in FIG. 5, the support members 68 are formed as downwardly extending projections of the intermediate member with their lower edges being either spaced from or in contact with the upper face of the sole.

The last components of the running shoe of the present invention are a plurality of force absorbing units or elements 44 located in parallel relationship with each other along the length of the platform from adjacent to the heel portion of the shoe to adjacent to the toe portion of the shoe. The units are shaped as toroids with walls 70 of resilient material filled with high viscosity fluid such as silicone fluid 72. The elements 44 have their upper extents 74 located on the upper surface of the intermediate platform for being contacted and contracted by the foot of a wearer. Their lower extents 76 are located in the channels 66 in the lower chamber 42 in contact with the lower surface of the platform. Their lower extents are adapted to be expanded in response to the elements being contracted in the upper chamber.

In a further embodiment of the invention, the support member could be eliminated and in its place, the lower extents of the toroid shaped members could be located in parallel slots formed in the sole of the shoe with the intermediate platform resting on the non-slotted portions of the sole. This embodiment allows the surface of the shoe supporting the foot of the wearer to be contoured more readily to the foot of the wearer for increased user comfort.

The fluid 72 in each of the walls 70 is at a pressure such that their walls will not deform when subjected to conditions of static forces as when a wearer is standing still. Such walls will, however, deform when subjected to conditions of greater than static forces as generated during walking or running by a wearer. The deformation of each of the walls occurs as fluid shifts within their walls to the chamber below the platform to thereby expand the walls beneath the platform. The walls will resile upon the relief of the deforming force to return fluid to the chamber above the platform. Each of the walls is adapted to deform in response to a particular, individual force determined as a function of the weight of the wearer and the force anticipated to be generated on that element as a result of jogging or the like by its wearer. The elements may be constructed with thinner walls at the central portion of the platform to deform in response to lesser forces adjacent to the central portion of the shoe and in response to greater forces adjacent to front and back portions of the shoe.

The forces exerted on the foot of a wearer, particularly during running, are generated unevenly along the length of the foot. In order to accommodate these various forces along the length of the foot, discrete force absorbing members are preferably utilized. Each such member is the shape of a toroid. Each such member may be of a different size as a function of its location along the length of the intermediate platform and as a function of the degree of force received on the adjacent portion of the wearer's foot. As can be understood by reference to the figures, each device is made of a continuous hollow member of resilient material filled with a material of high viscosity, a liquid resistant to flow.

Figure 6:
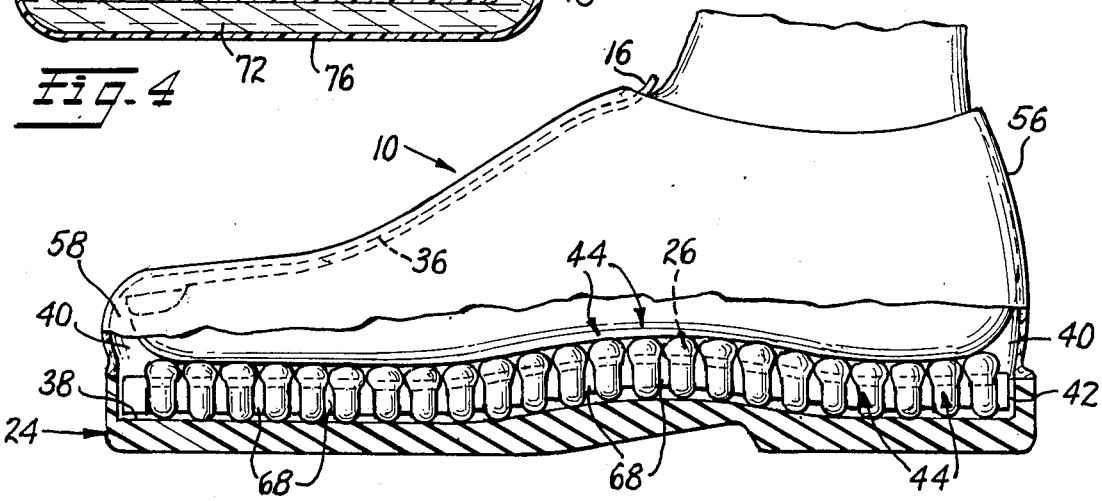
FIG. 6 is a side elevational view of the shoe shown in FIGS. 1 through 4 partly in section but illustrating a wearer's foot during running and the deformations caused thereby.

By way of example only, if the shoe were worn by a 170 lb. man and 17 such torus shaped members were utilized, each such member would be adapted to support an average of 10 lbs. of pressure. Since the poundage of pressure is applied over a different width and area, each member would have its exterior shell of a different size so that only slight deformation of the members would occur when the wearer was merely standing on the members. During running, however, each member would receive a different force, the highest forces being adjacent the heel and toe where the nature of the running exerts extremely high forces on such areas. The central portion of the shoe would receive lesser forces. Regions between the central portion and the end portions would receive intermediate forces. Note FIG. 6. During running, up to twenty-five percent (25%) of the fluid from the upper chamber may be transferred to the lower chamber.

As an operative embodiment, the walls of the elements might be fabricated of silicone elastomer having a wall thicknesses of about between one and two millimeters. In such embodiment, a silicone fluid having a viscosity of about between 500 and 1,000 centepoises, preferably about between 650 and 750 centepoises would be utilized.

The present disclosure includes that contained in the appended claims as well as that of the foregoing description. Although this invention has been described in its preferred forms with a certain degree of particularity, it is understood that the present disclosure of the preferred form has been made only by way of example and that numerous changes in the details of construction and combination and arrangement of parts may be resorted to without departing from the spirit of the invention.

Now that the invention has been described, what is claimed is:

1. A shoe including an upper component and a sole component for receiving the foot of a wearer therebetween, the shoe also including a plurality of force absorbing units positioned between the upper and sole components, each unit having a first portion to receive the wearer's foot thereon and a remote second portion whereby, in response to forces exerted on the units by the wearer's foot, the first portions of the units will contract and the second portions of the units will expand to thereby absorb and distribute such exerted forces and further including support means of substantial rigidity in operative proximity to the second portions of the units to preclude the compression of the second portions when the first portions contract.

2. The shoe as set forth in claim 1 wherein the support means is an intermediate component located between the upper and sole components with the first portions of the units located above the intermediate component.

3. The shoe as set forth in claim 2 wherein the units are shaped as toroids with their first portions above the intermediate component and with their second portions beneath the intermediate component.

4. The shoe as set forth in claim 3 wherein the toroid shaped units are formed of shells of resilient material filled with fluid.

5. The shoe as set forth in claim 4 wherein the fluid is a high viscosity silicone.

6. The shoe as set forth in claim 4 wherein the fluid in each shell is at a pressure such that its shell will not deform substantially when subjected to conditions of static forces but will deform substantially when subjected to conditions of greater than static forces.

7. The shoe as set forth in claim 6 wherein the deformation of each shell occurs as fluid shifts within its shell from the portion above the intermediate component to the portion below the intermediate component to expand the shell below the intermediate component and wherein the shell resiles upon the relief of the deforming force to return fluid to the portion above the intermediate component.

8. The shoe as set forth in claim 7 wherein each shell is constructed and pressurized with fluid to deform in response to a particular, individual magnitude of force determined as a function of the weight of the wearer and the magnitude of force anticipated to be generated on each unit as a result of use by its wearer.

9. The shoe as set forth in claim 8 wherein the units are constructed and positioned to deform in response to magnitudes of lesser forces adjacent to the central part of the intermediate component and to magnitudes of greater forces adjacent to front and back parts of the intermediate component.

10. A therapeutic shoe for use by a wearer comprising in combination:

an upper positionable over the foot of a wearer;

a sole peripherally secured to the upper and located beneath the foot of a wearer;

an intermediate platform located between the upper and the sole to define a lower area therebeneath and an upper area thereabove for the receipt of a foot of a wearer; and a plurality of toroid shaped, force absorbing means located in parallel relationship with each other along the length of the platform from adjacent to the heel end of the shoe to adjacent to the toe end of the shoe, the means having their upper extents located in the upper area on the upper surface of the platform for being contacted and contracted by the foot of a wearer and with their lower extents located in the lower area proximate to the lower surface of the platform for being expanded in response to the means being contracted in the upper area, the intermediate platform constituting support means of substantial rigidity so as such lower extents will not compress upon the compression of the upper extents.

11. The therapeutic shoe as set forth in claim 10 wherein the platform is formed with pairs of laterally spaced notches along its length for the receipt of a means through each pair of openings.

12. The therapeutic shoe as set forth in claim 11 and further including a support member located in the lower area in contact with the lower face of the platform and the upper face of the sole and extending along the length of the shoe.

13. The therapeutic shoe as set forth in claim 12 wherein the support members define channels of a size and location corresponding to the lower extents of the force absorbing means.

14. The therapeutic shoe as set forth in claim 13 wherein the support members are formed as upward extensions of the sole.

15. The therapeutic shoe as set forth in claim 13 wherein the support members are formed as downward extensions of the intermediate member.

16. A therapeutic shoe for use as by a wearer during jogging or the like comprising in combination:

an upper positionable over the foot of a wearer;

a sole peripherally secured with respect to the upper beneath the foot of a wearer;

an intermediate platform located between the upper and the sole to define a lower chamber therebeneath and an upper chamber thereabove for the receipt of a foot of a wearer; and a plurality of force absorbing elements located in parallel relationship with each other along the length of the platform from adjacent to the heel part of the shoe to adjacent to the toe part of the shoe, the units being shaped as toroids with walls of resilient material filled with high viscosity fluid under pressure, the elements having their upper extents located on the upper surface of the platform for being contacted and contracted by the foot of a wearer and with their lower extents located in the lower chamber on the lower surface of the platform for being expanded in response to the elements being contracted in the upper chamber, the fluid in each of the walls being at a pressure such that their walls will not deform substantially when subjected to normal conditions of static forces but will deform substantially when subjected to conditions of dynamic forces with the deformation of the walls occurring as fluid shifts to the lower chamber below the platform to expand the walls and wherein the walls rely upon the relief of the deforming force to return fluid to the upper chamber above the platform, each of the walls being adapted to deform in response to a particular, individual force determined as a function of the weight of the wearer and the force anticipated to be generated on that element as a result of jogging or the like by its wearer, the elements being constructed and positioned to deform in response to lesser forces adjacent to the central part of the shoe and in response to greater forces adjacent to toe and heel parts of the shoe, the intermediate platform constituting support means of substantial rigidity so that compression of the elements in the upper chamber will not compress the elements in the lower chamber.

* * * * *